US007654443B1

(12) United States Patent
Fuller et al.

(10) Patent No.: US 7,654,443 B1
(45) Date of Patent: Feb. 2, 2010

(54) EASY GLIDE GARBAGE CONTAINER

(76) Inventors: Elois Fuller, 471 NW. 44 Ave., Plantation, FL (US) 33317; Jerry Fuller, 471 NW. 44 Ave., Plantation, FL (US) 33317

( * ) Notice: Subject to any disclaimer, the term of this patent is extended or adjusted under 35 U.S.C. 154(b) by 77 days.

(21) Appl. No.: 11/934,026

(22) Filed: Nov. 1, 2007

(51) Int. Cl.
*A47G 29/12* (2006.01)

(52) U.S. Cl. ..... 232/43.2; 220/908

(58) Field of Classification Search ..... 232/43.2, 232/43.1, 30–32; 220/908.1, 908, 495.06, 220/495.08, 495.11, 23.87, 23.89
See application file for complete search history.

(56) References Cited

U.S. PATENT DOCUMENTS 3,204,866 A * 9/1965 Brighton et al. ..... 232/43.2
3,807,299 A * 4/1974 Engebretsen ..... 100/218
4,023,875 A * 5/1977 Difley et al. ..... 312/319.1
4,577,778 A * 3/1986 Kim ..... 220/495.07
4,955,497 A * 9/1990 Winden et al. ..... 232/43.2
5,011,026 A * 4/1991 Hausman et al. ..... 209/675
5,076,458 A * 12/1991 Weiner et al. ..... 220/23.86
5,137,212 A * 8/1992 Fiterman et al. ..... 232/43.2
5,884,556 A * 3/1999 Klepacki et al. ..... 100/349
6,234,339 B1 * 5/2001 Thomas ..... 220/495.07
6,241,115 B1 * 6/2001 Delmerico et al. ..... 220/495.06

* cited by examiner

*Primary Examiner*—William L. Miller
(74) *Attorney, Agent, or Firm*—Allen D. Hertz

(57) ABSTRACT

A garbage container incorporates an access located along one side of the container. The access port can be enclosed by a door. An access section bag holding structure can be incorporated across the top edge of the access. The side access garbage container allows the user to remove the garbage bag without lifting it from the container, but simply by sliding the filled bag out from the access section. The access can be incorporated into a stand alone container or one placed within a cabinet.

17 Claims, 12 Drawing Sheets

EASY GLIDE GARBAGE CONTAINER

FIELD OF THE INVENTION

The invention relates to an apparatus and method for removing a trash bag from a trash container, more specifically the integration of a side access member.

BACKGROUND OF THE INVENTION

Garbage containers are fabricated in many form factors.

Commonly known garbage containers comprise a bottom and four sides, wherein the four sides complete surround the perimeter of the container. An optional garbage bag can be placed within the garbage container securing the opening of the garbage bag about the top of the garbage container. This design dictates that the user lift the full trash bag from the container.

These commonly known garbage containers can be placed within an external enclosure. The external container can include a door, a garbage deposition door, and the like. These are still limited in that the user is required to lift the trash bag from the commonly known garbage container.

What is desired is a means for removing a trash bag from a trash container while minimizing the required effort of the individual.

SUMMARY OF THE PRESENT INVENTION

A first aspect of the present invention is a garbage container comprising a sidewall, wherein the sidewall includes a sidewall access area.

Yet another aspect of the present invention is the inclusion of a bag support member spanning across the upper region of the sidewall access area.

Yet another aspect of the present invention is the inclusion of a bag securing member located in an upper section of the sidewalls of the sidewall accessible garbage container.

Yet another aspect of the present invention is wherein the sidewall access area is enclosed by an access door.

Yet another aspect is a sidewall accessible garbage container in a rectangular shape.

Yet another aspect is a sidewall accessible garbage container in a square shape.

Yet another aspect is a sidewall accessible garbage container in a rounded shape.

Yet another aspect is a sidewall accessible garbage container in a circular shape.

Yet another aspect is a sidewall accessible garbage container having a garbage deposition aperture in a top section of the sidewall accessible garbage container.

Yet another aspect is a sidewall accessible garbage container comprising a top cover incorporating a garbage deposition aperture.

Yet another aspect is a sidewall accessible garbage container comprising a raised top cover incorporating a garbage deposition aperture.

Yet another aspect is a sidewall accessible garbage container comprising a raised top cover incorporating a garbage deposition aperture in a non-horizontal surface.

Yet another aspect is a sidewall accessible garbage container comprising a raised top cover incorporating a door enclosing the garbage deposition aperture.

An aspect of the access door is that the door is pivotally coupled to the container via a hinge.

Yet another aspect of the access door is that the door is slide-ably coupled to the container via a slide mechanism.

Yet another aspect of the access door is that the door is slide-ably coupled to the container via a slide mechanism, the slide mechanism being assisted by bearings.

Yet another aspect places a side accessible garbage container within an external enclosure, the external enclosure incorporating a side access door.

Yet another aspect assembles the side accessible garbage container within an external enclosure using a sliding mechanism.

Yet another aspect assembles the sliding mechanism along the bottom of the side accessible garbage container.

Yet another aspect assembles the sliding mechanism along the side of the side accessible garbage container.

Yet another aspect incorporates a garbage deposition door into the external enclosure.

Yet another aspect places the garbage deposition door in a sidewall of the external enclosure.

Yet another aspect places the garbage deposition door in a top member of the external enclosure.

BRIEF DESCRIPTION OF THE DRAWING

For the purpose of initially illustrating the invention, the specification presents drawings, flow diagrams, and embodiments that are presently preferred as well as alternates. It should be understood, however, that the invention is not limited to the specific instrumentality and methods disclosed herein. It can be recognized that the figures represent a layout in which persons skilled in the art may make variations therein. In the drawings.

DETAILED DESCRIPTION OF THE DRAWING

Figure 1:
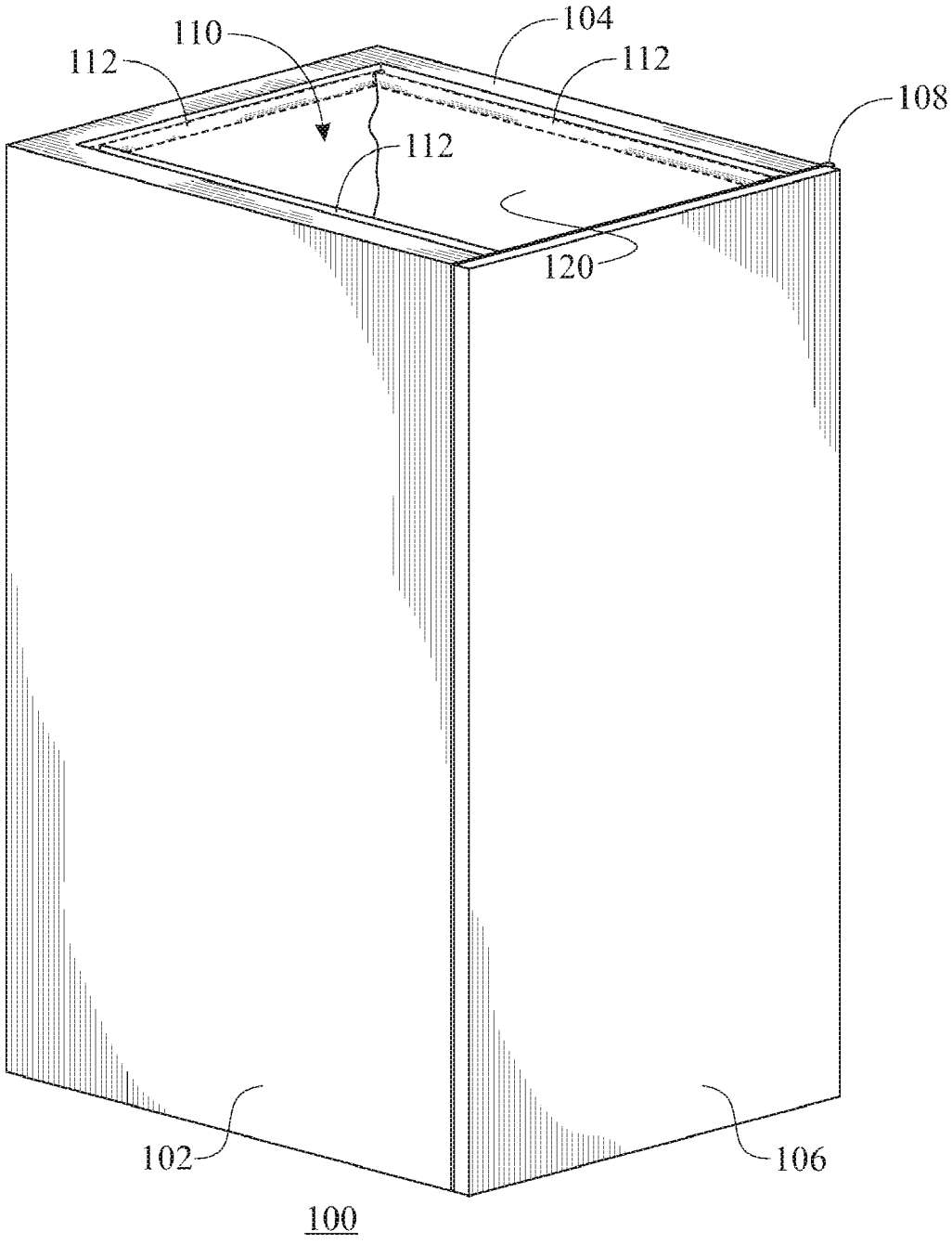
FIG. 1 illustrates an isometric view of a first embodiment of a side access garbage container shown in a closed orientation.
Figure 2:
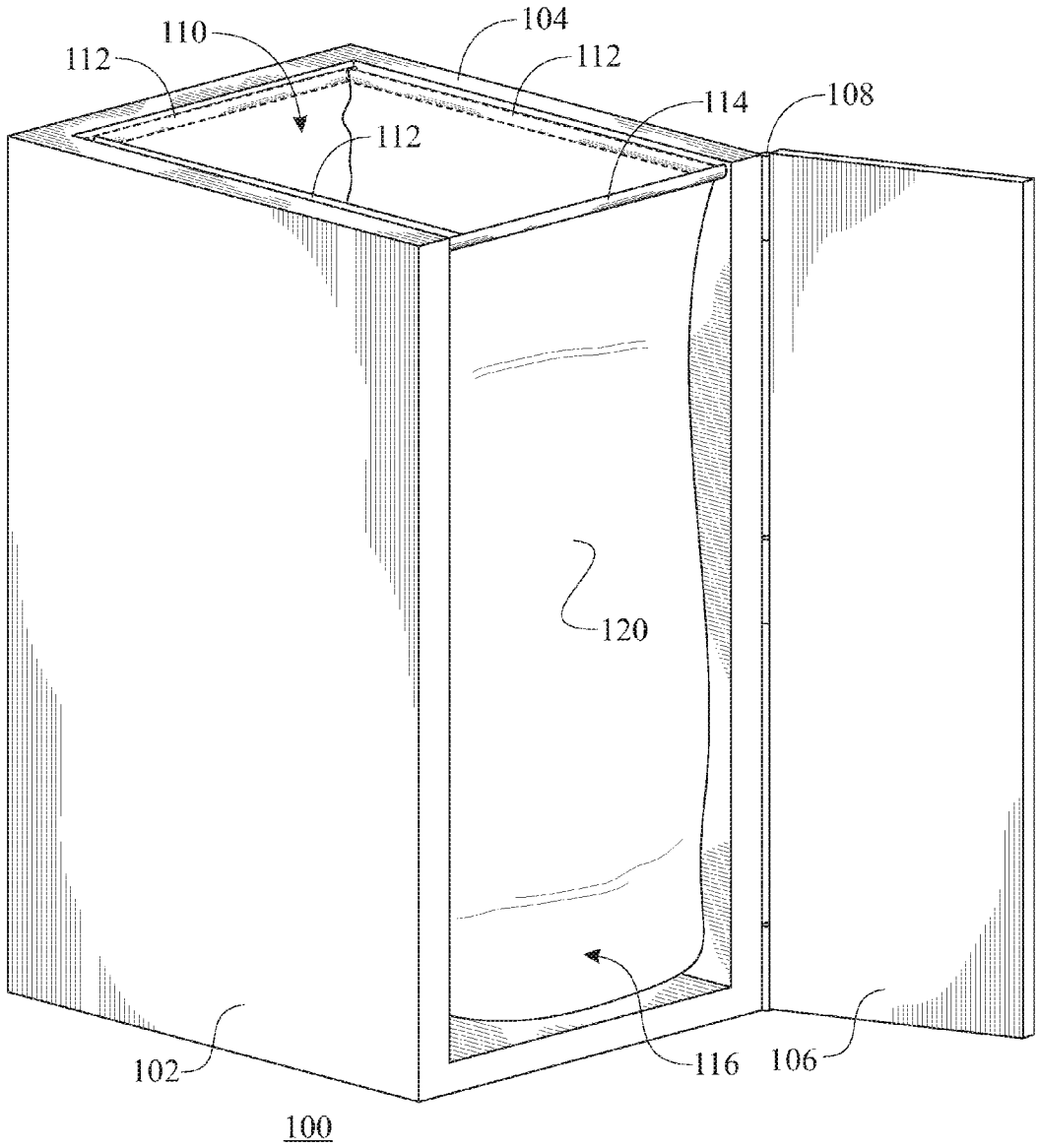
FIG. 2 illustrates an isometric view of the first embodiment presented in FIG. 1 shown in an open orientation.

FIGS. 1 and 2 illustrate an isometric view of a side access garbage container 100. FIG. 1 presents the side access garbage container 100 in a door closed configuration; FIG. 2 presents the side access garbage container 100 in a door open configuration. The side access garbage container 100 comprising a sidewalls 102 and an access door 106; the access door 106 providing an access to a trash removal access 116. The sidewalls 102 can be referred to as a substantially rigid sidewall, wherein the sidewall is used to aid in containing the removable trash bag 120. This includes a sidewall 102 that is solid, perforated, mesh, and the like, wherein the sidewall provides support to the removable trash bag 120 while trash is being deposited. The access door 106 is assembled to the sidewalls 102 via door hinges 108 and provides support to the removable trash bag 120 when closed. An access section bag holder 114 is assembled spanning across the top portion of the trash removal access 116. A plurality of sidewall bag holder 112 can be included in the side access garbage container 100, wherein the sidewall bag holder 112 aligns with the access section bag holder 114 providing a planar system for securing a removable trash bag 120. The user would install the removable trash bag 120 by placing the bag into the container and wrapping the perimeter of the removable trash bag 120 about either the top edge 104 and access section bag holder 114 or the side wall bag holder 112 and the access section bag holder 114. The removable trash bag 120 would be secured to side access garbage container 100 via a bag securing mechanism (not shown) such as a clip, tape, a tie, and the like. Garbage is deposited into the removable trash bag 120 via a top opening 110 formed when the bag 120 is stretched about the bag holding member.

Figure 3:
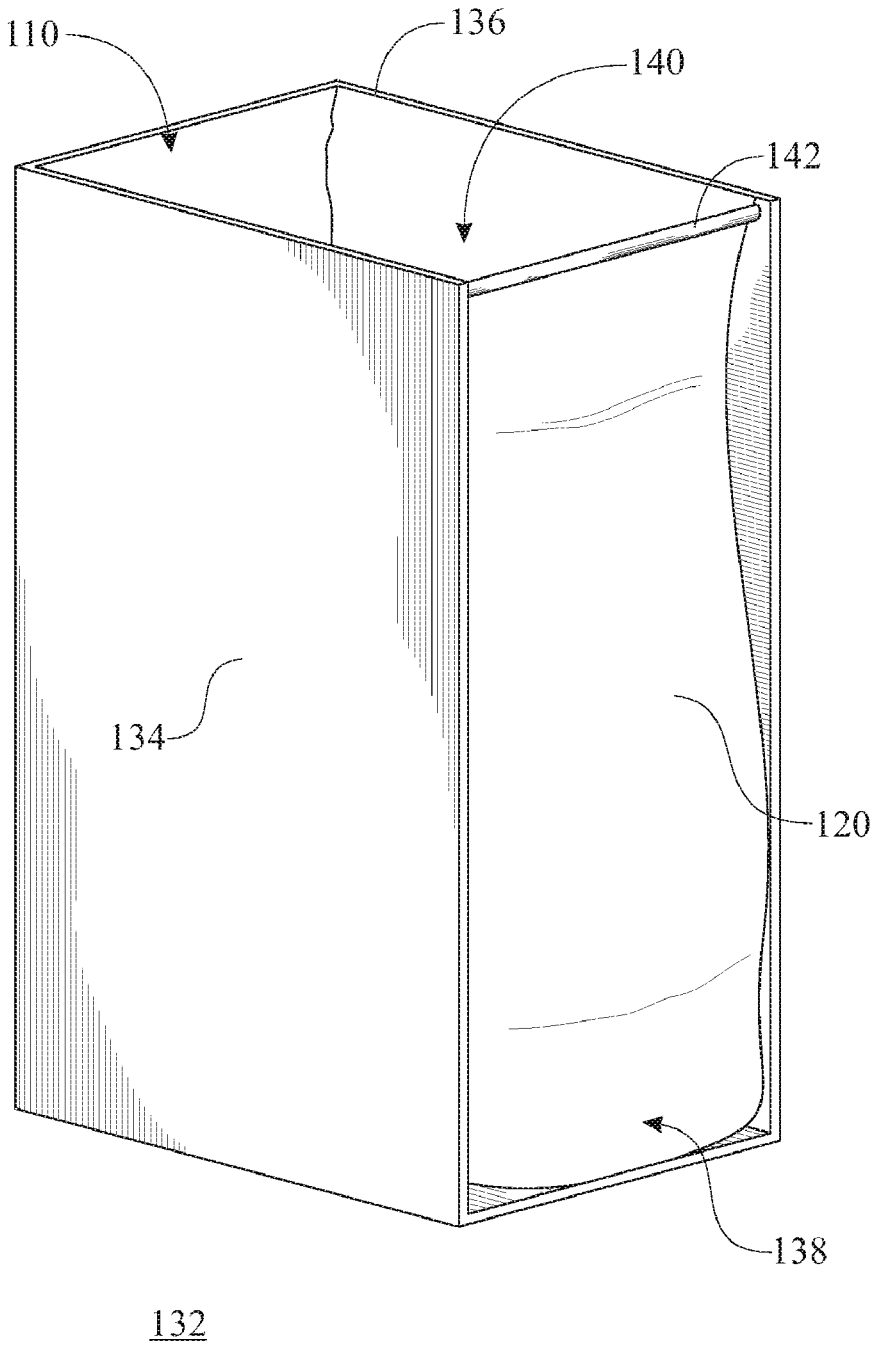
FIG. 3 illustrates an isometric view of a second embodiment of a side access garbage container which is utilized in conjunction with larger trash collection containment fixtures.
Figure 4:
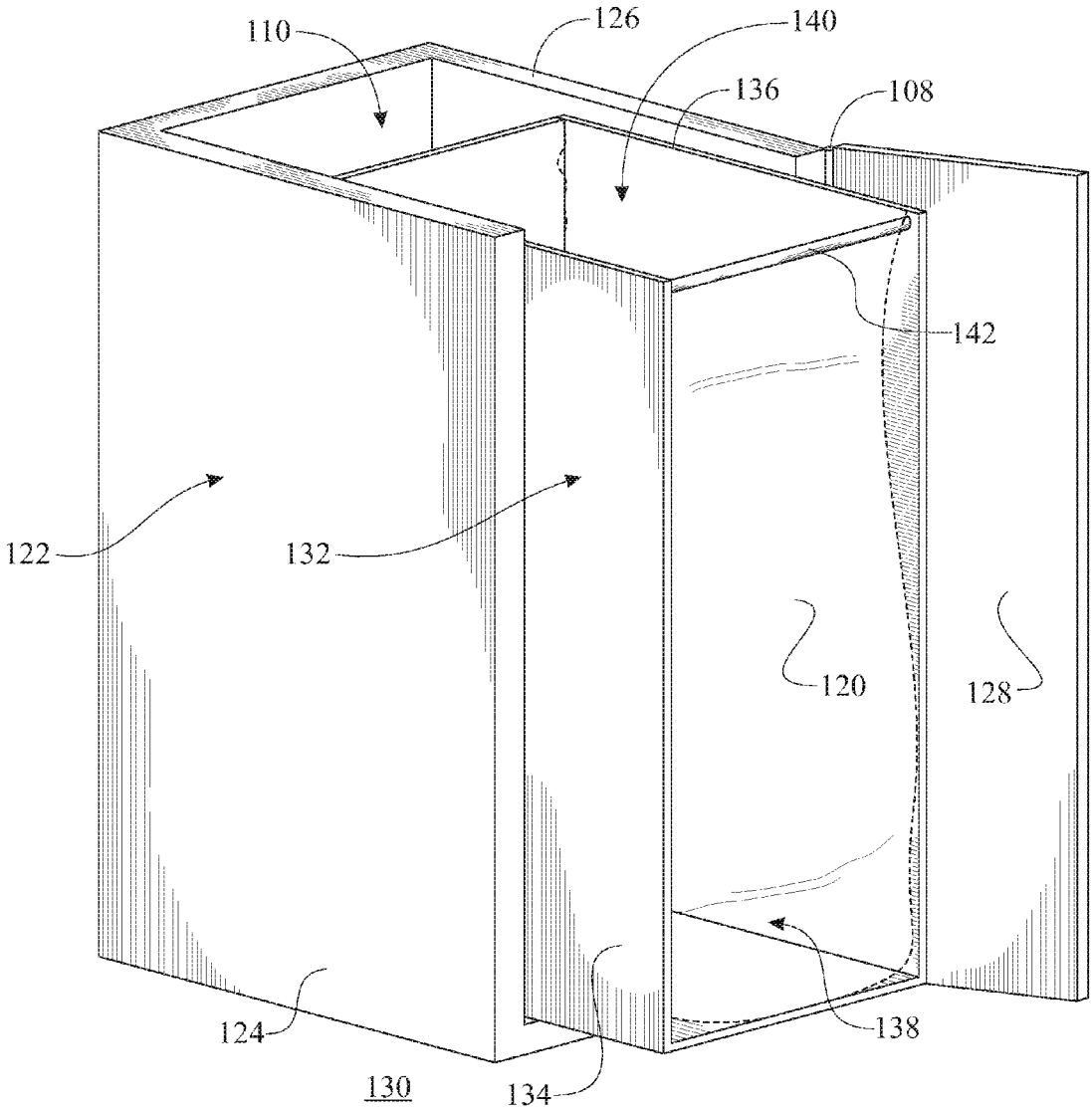
FIG. 4 illustrates an isometric view of the second embodiment presented in FIG. 3 installed in a stand alone trash collection containment fixture.
Figure 5:
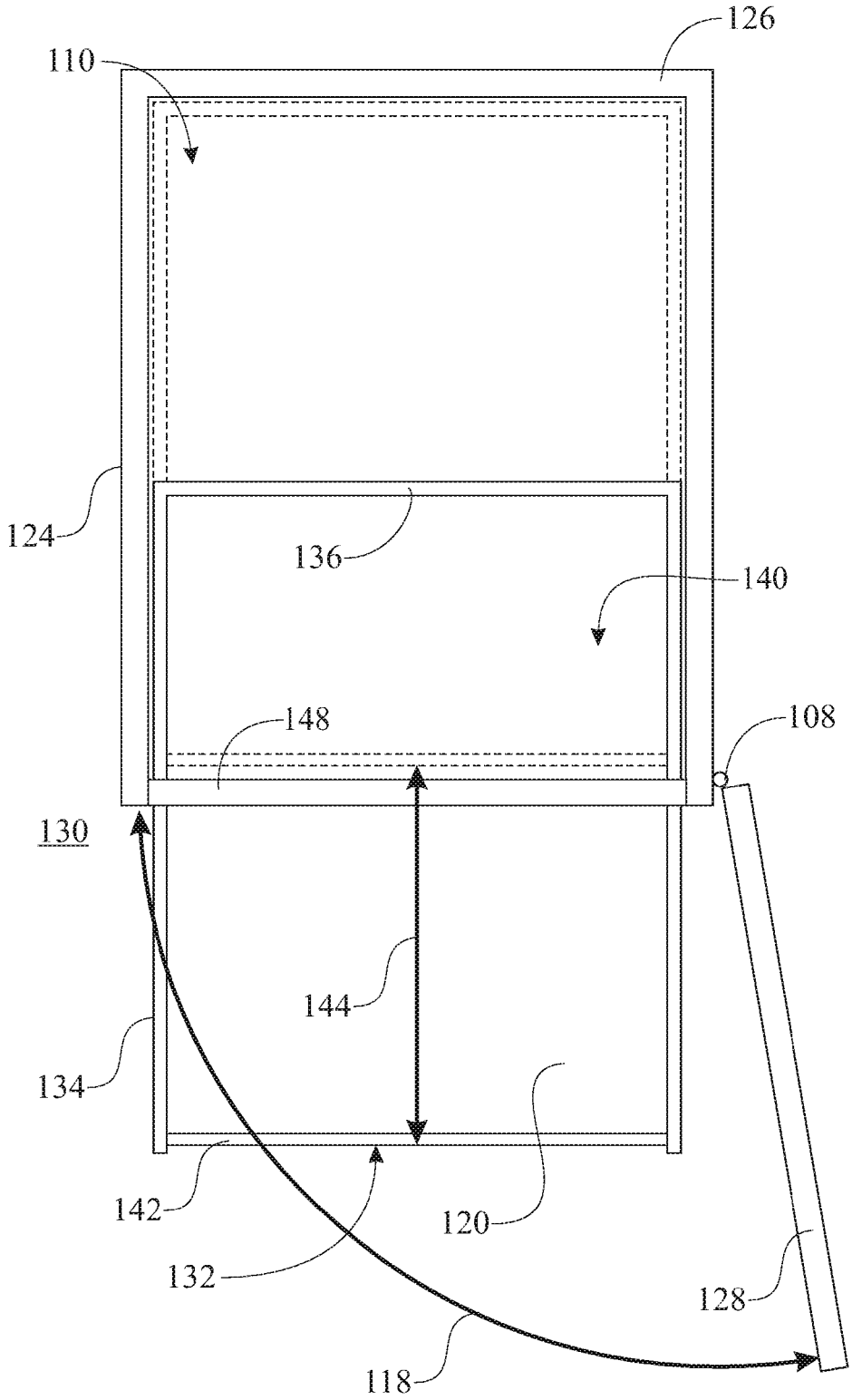
FIG. 5 illustrates a top view of the installed second embodiment as presented in FIG. 4.
Figure 6:
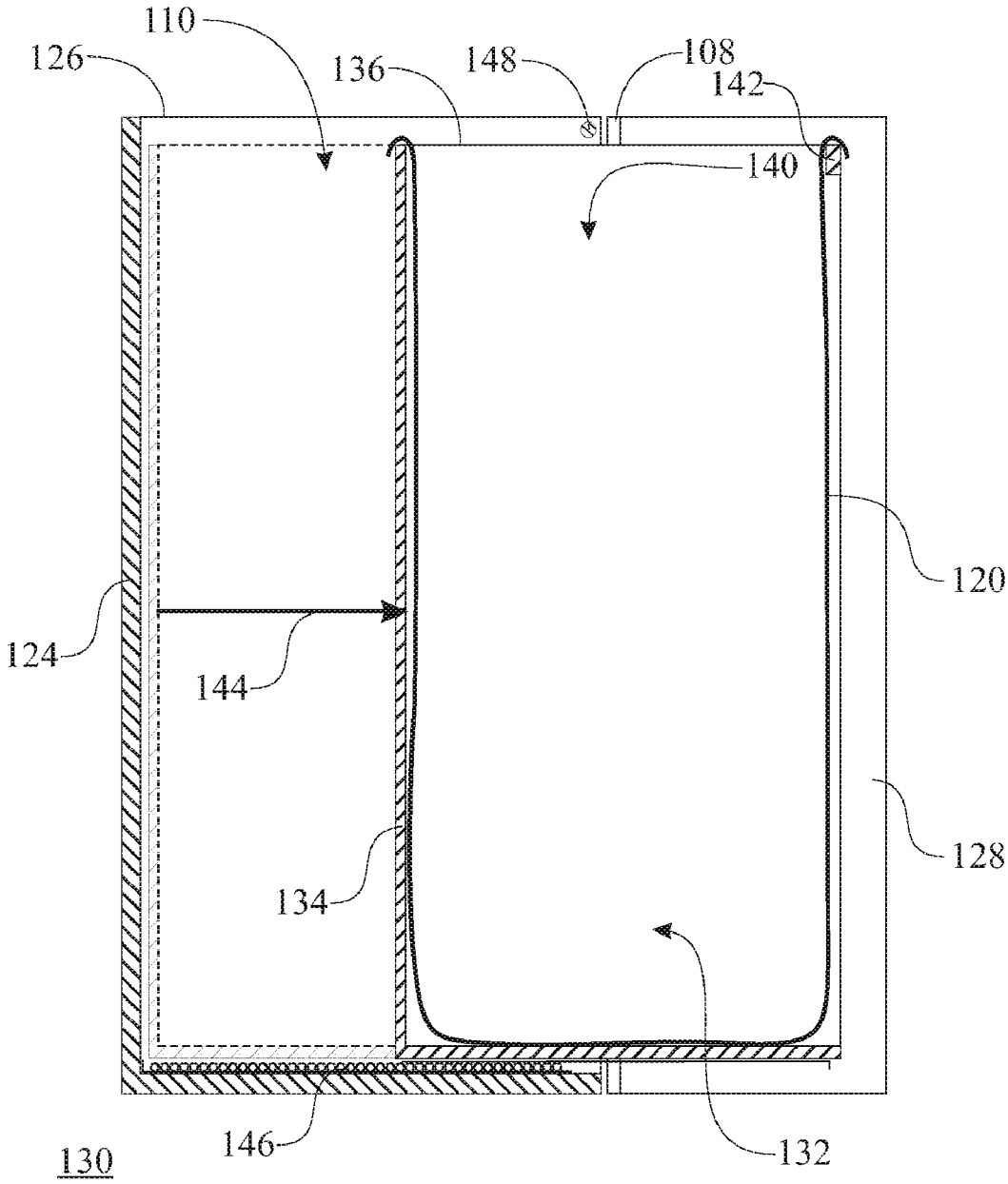
FIG. 6 illustrates a side, sectional view of the installed second embodiment as presented in FIG. 4.
Figure 7:
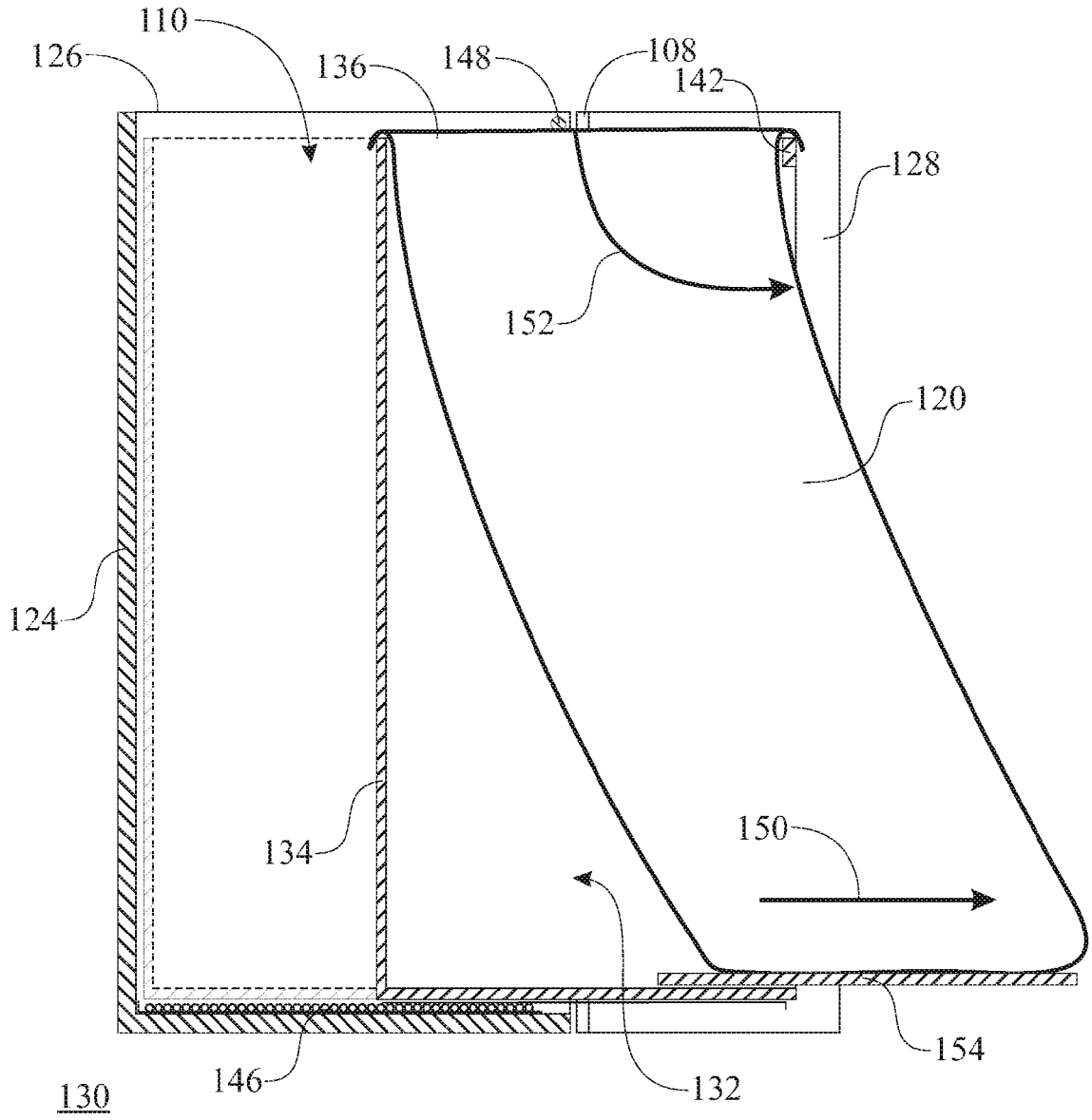
FIG. 7 illustrates a side, sectional view of the installed second embodiment as presented in FIG. 4, presenting the removal process for removing a garbage bag.

FIGS. 3 through 7 illustrate a slide out side access assembly 130. FIG. 3 presents a slide out side accessible garbage container 132 prior to installation into the slide out side access assembly 130, whereas FIG. 4 presents the slide out side accessible garbage container 132 as installed. FIG. 5 presents a top view of the slide out side access assembly 130 presenting the motions during use of the apparatus. FIGS. 6 and 7 present a cross sectional side view of the slide out side access assembly 130 presenting the motions during use of the apparatus.

The slide out side access assembly 130 utilizes a slide out side accessible garbage container 132 placed inside an external enclosure, the enclosure comprising an external enclosure 122, an external enclosure sidewalls 124, and an external enclosure top edge 126. The external enclosure top edge 126 is secured to the external enclosure 122 via door hinges 108. The external enclosure 122 encompasses three sides of the slide out side accessible garbage container 132, with an opening wherein the slide out side accessible garbage container 132 can slide in and out of in accordance with a slide out motion 144. An enclosure top support 148 is assembled across the top of the open section of the external enclosure 122, the enclosure top support 148 providing structural support. The external enclosure door 128 pivots providing both a closure to the slide out container access section 138 of slide out side accessible garbage container 132, as well as access to the slide out side accessible garbage container 132 for removal of the removable trash bag 120 when desired. The slide out side accessible garbage container 132 is fabricated having a slide out container side walls 134, wherein the slide out container side walls 134 provides a partial circumference of the slide out side accessible garbage container 132, leaving the slide out container access section 138 exposed for aiding in the removal of the removable trash bag 120. The slide out container sidewalls 134 provides support to the removable trash bag 120 as it is being filled. The external enclosure door 128 provides support to the removable trash bag 120 when the external enclosure door 128 is placed in a closed orientation. A slide out access section bag holding member 142 is assembled across the upper edge of the slide out container access section 138, wherein the slide out access section bag holding member 142 provides structural support to the slide out side accessible garbage container 132 as well as a means for supporting the section of the removable trash bag 120, which spans across the upper portion of the slide out container access section 138. The slide out side accessible garbage container 132 includes a slide out container top opening 140, the slide out container top opening 140 providing a trash depository opening where the user would deposit any trash.

The user fills the removable trash bag 120 over time. Once filled, the user accesses the removable trash bag 120 via opening the external enclosure door 128 in accordance with a door opening motion 118 and sliding the slide out side accessible garbage container 132 outward in accordance with a slide out motion 144. The user then removes the removable trash bag 120 by releasing the upper edge of the removable trash bag 120 from the slide out container top edge 136 (or side wall bag holder 112 if incorporated) via a bag top removal motion 152 and sliding the base of the removable trash bag 120 outward via a bag bottom motion 150. A slide mechanism 146 can be included to aid in the sliding motion. The slide mechanism 146 can be assembled to the bottom, sides, or both of the slide out side access assembly 130. An optional sliding bag removal assistance base 154 can be incorporated to aid in the bag bottom motion 150, wherein the bag would rest on the top of the optional sliding bag removal assistance base 154 and the optional sliding bag removal assistance base 154 would be slideably coupled to the container bottom. It is recognized the optional sliding bag removal assistance base 154 can be incorporated into any of the presented embodiments submitted herein and should be incorporated by reference accordingly.

Figure 8:
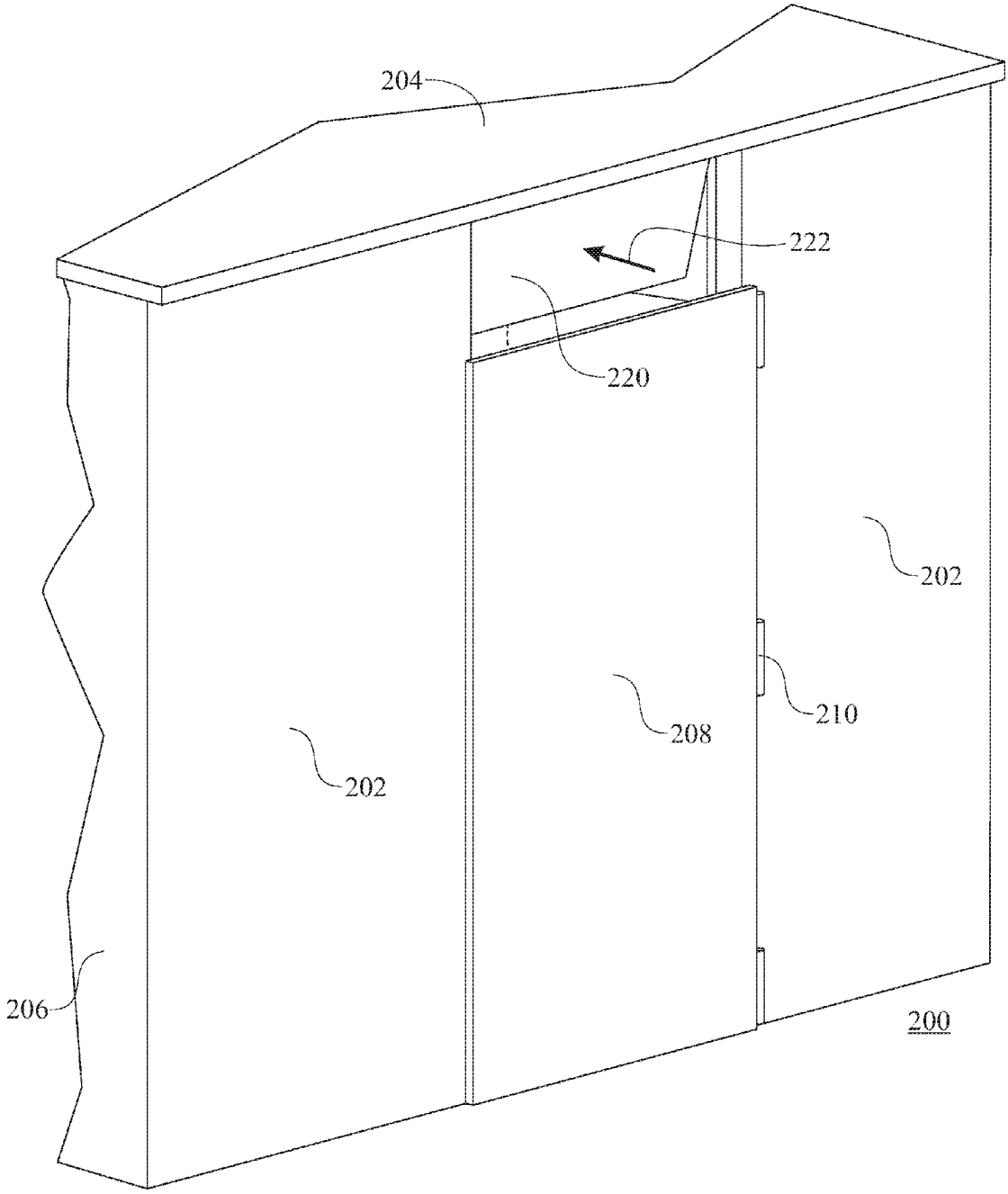
FIG. 8 illustrates an isometric view of the second embodiment presented in FIG. 3 installed in a cabinet trash collection containment fixture shown in a closed orientation.
Figure 9:
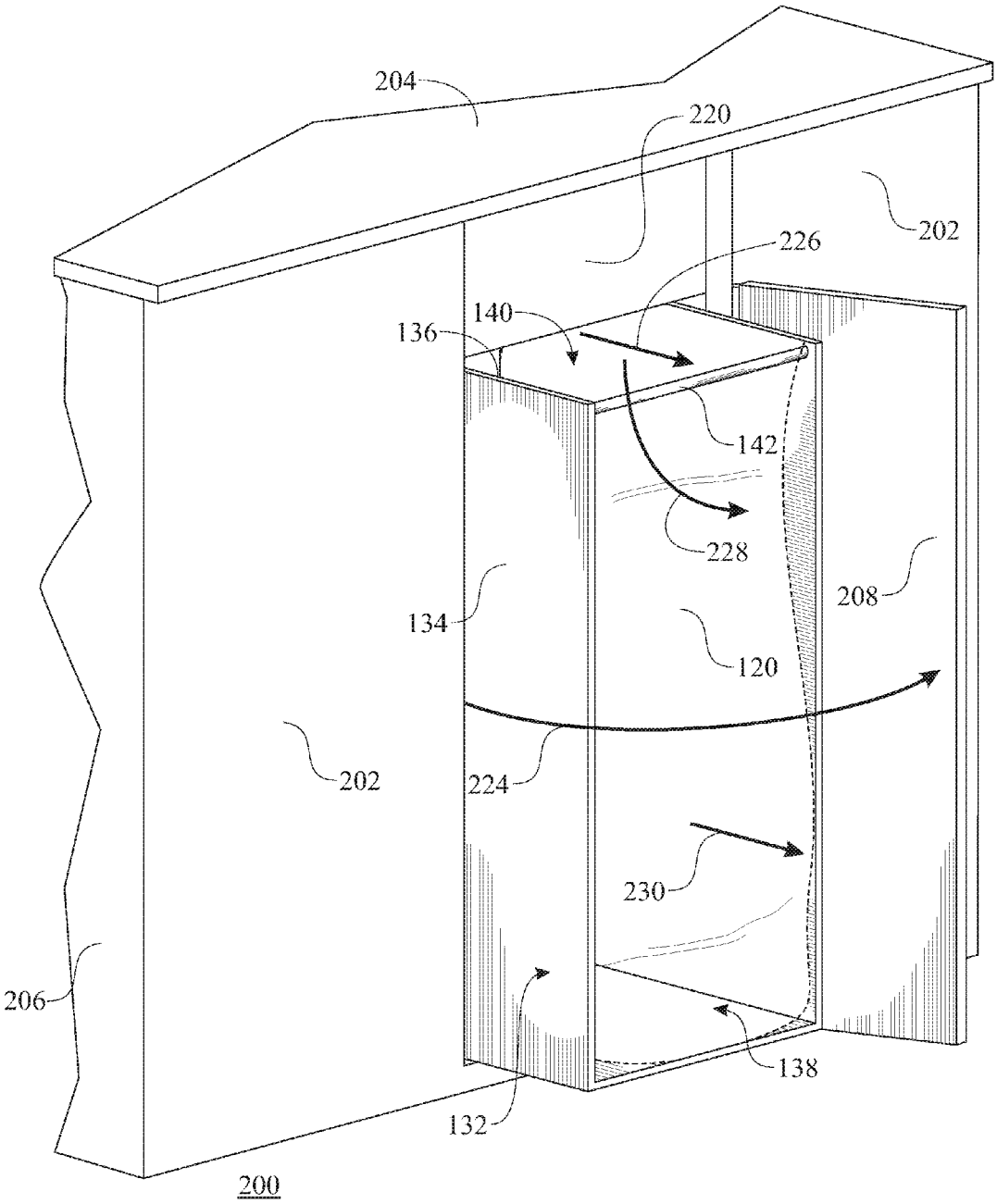
FIG. 9 illustrates an isometric view of the installed second embodiment as presented in FIG. 8, presenting the removal process for removing a garbage bag.

FIGS. 8 and 9 illustrate a side access garbage container cabinet 200; FIG. 8 presenting the side access garbage container cabinet 200 in a closed configuration, and FIG. 9 presenting the side access garbage container cabinet 200 in an open configuration. The side access garbage container cabinet 200 is fabricated having a cabinet front 202, a cabinet countertop 204, and an optional cabinet side 206. A cabinet garbage door 208 is assembled to the cabinet front 202 via a plurality of cabinet door hinges 210. The slide out side accessible garbage container 132 is placed within a cavity within the side access garbage container cabinet 200, wherein the slide out side accessible garbage container 132 is utilized as previously described. The user opens the garbage deposition door 220 via a garbage deposition door motion 222 depositing any trash into the removable trash bag 120 via the slide out container top opening 140.

Once filled, the user accesses the removable trash bag 120 via opening the cabinet garbage door 208 in accordance with a garbage removal door motion 224 and sliding the slide out side accessible garbage container 132 outward in accordance with a sliding motion 226. The user then removes the removable trash bag 120 by releasing the upper edge of the removable trash bag 120 from the slide out container top edge 136 and slide out access section bag holding member 142 (or side wall bag holder 112 if incorporated) via a garbage bag disengaging motion 228 and sliding the base of the removable trash bag 120 outward via a garbage bag removal motion 230.

Figure 10:
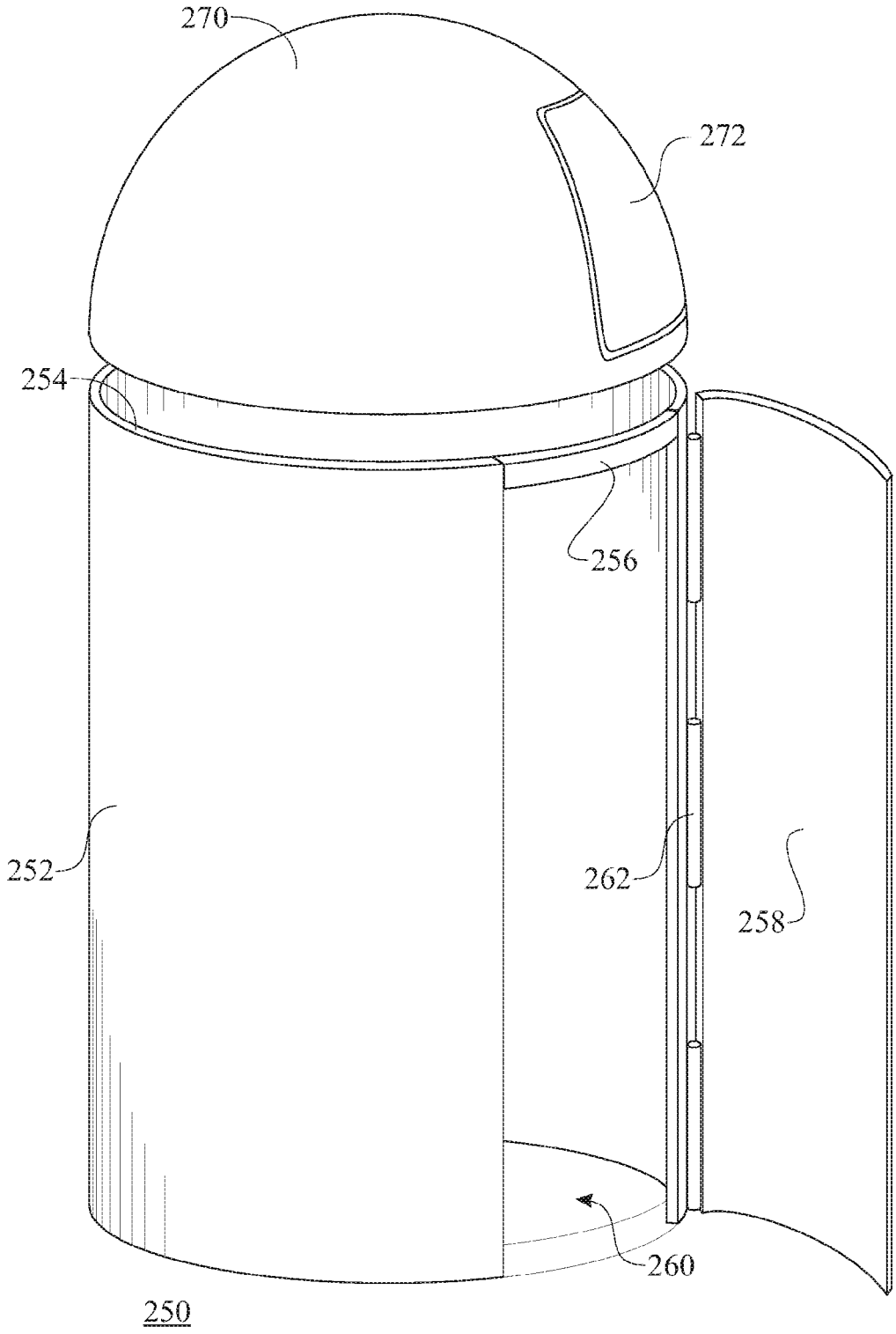
FIG. 10 illustrates yet another embodiment of the present invention, of a round, side access garbage container.

FIG. 10 illustrates a rounded front access garbage container 250. The rounded front access garbage container 250 comprising a rounded container sidewall 252 and a rounded container access door 258 for enclosing a rounded container access opening 260. A rounded container top edge 254 is defined along the top edge of the rounded container sidewall 252. Since the rounded container side wall 252 does not follow the complete perimeter of the rounded front access garbage container 250, a access section upper bag holder 256 is assembled along the top edge of the rounded container access opening 260, the providing a complete upper perimeter for securing the bag (not shown). The rounded container access door 258 is assembled via a plurality of rounded container hinges 262. A garbage deposition cover 270 includes a garbage deposition cover door 272 and is placed on the rounded container top edge 254 to provide an aesthetically pleasing overall appearance.

Figure 11:
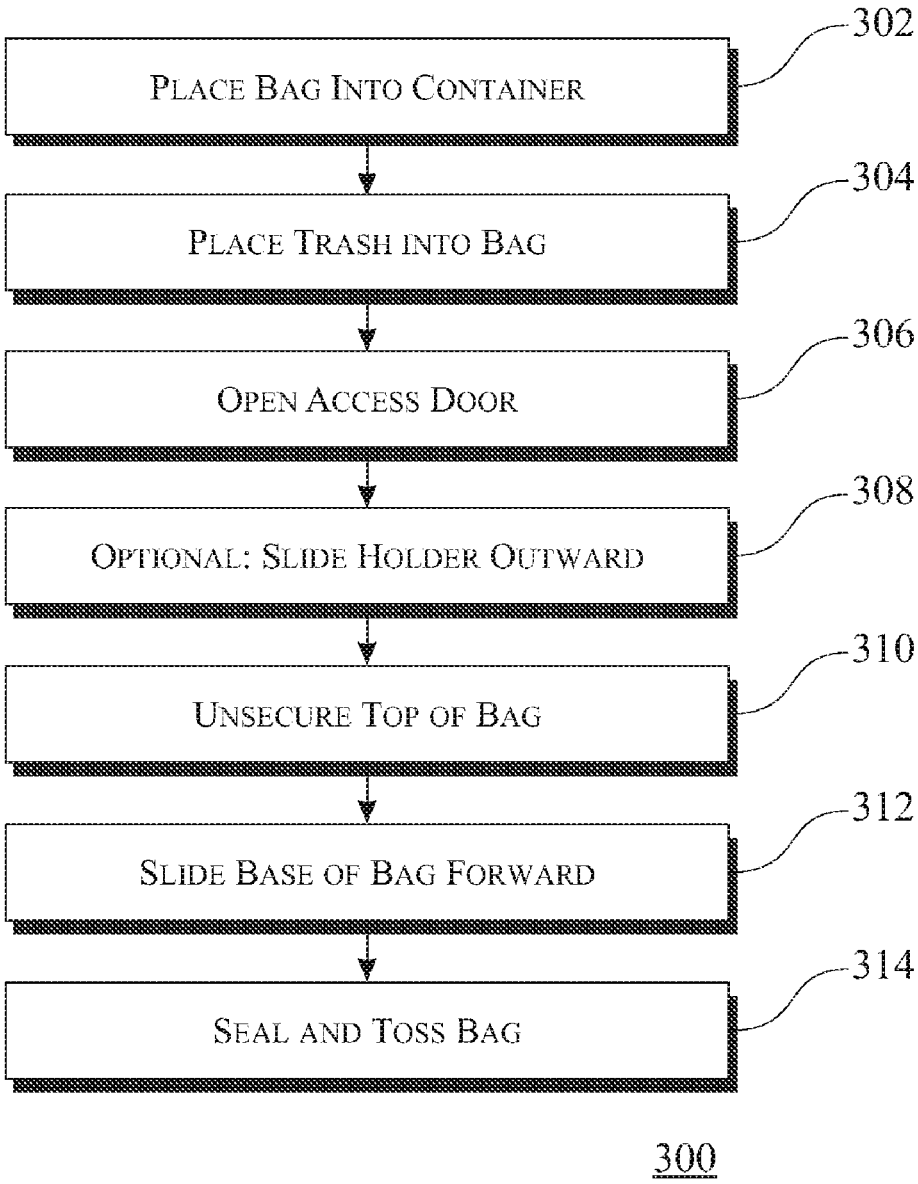
FIG. 11 illustrates a side access garbage container method of use flow diagram.

FIG. 11 provides a side access garbage container method of use flow diagram 300. The side access garbage container method of use flow diagram 300 initiates with a placing the garbage bag into the container step 302, wherein the user places the removable trash bag 120 into the side access container and secures the edge of the removable trash bag 120 to the bag securing section of the side access container. The user could secure the removable trash bag 120 in place if a bag securing mechanism is included in the apparatus. Trash is placed into the removable trash bag 120 via a container garbage opening as per a placing garbage into the bag step 304. Once the removable trash bag 120 is filled with trash, the user opens the access door in accordance with an open the access door step 306. The user can optionally slide the side access garbage container outward from the external enclosure as referenced via a slide container outward step 308. The user then completes an un-secure the top of the bag step 310. This would be completed respective to the means in which the removable trash bag 120 is secured within the side access garbage container. The un-secure the top of the bag step 310 drops the bag to the bottom of the side access garbage container. The user then completes a slide the base of the bag outward step 312. The removable trash bag 120 is then sealed and disposed of in accordance with a seal and toss the bag step 314.

Figure 12:
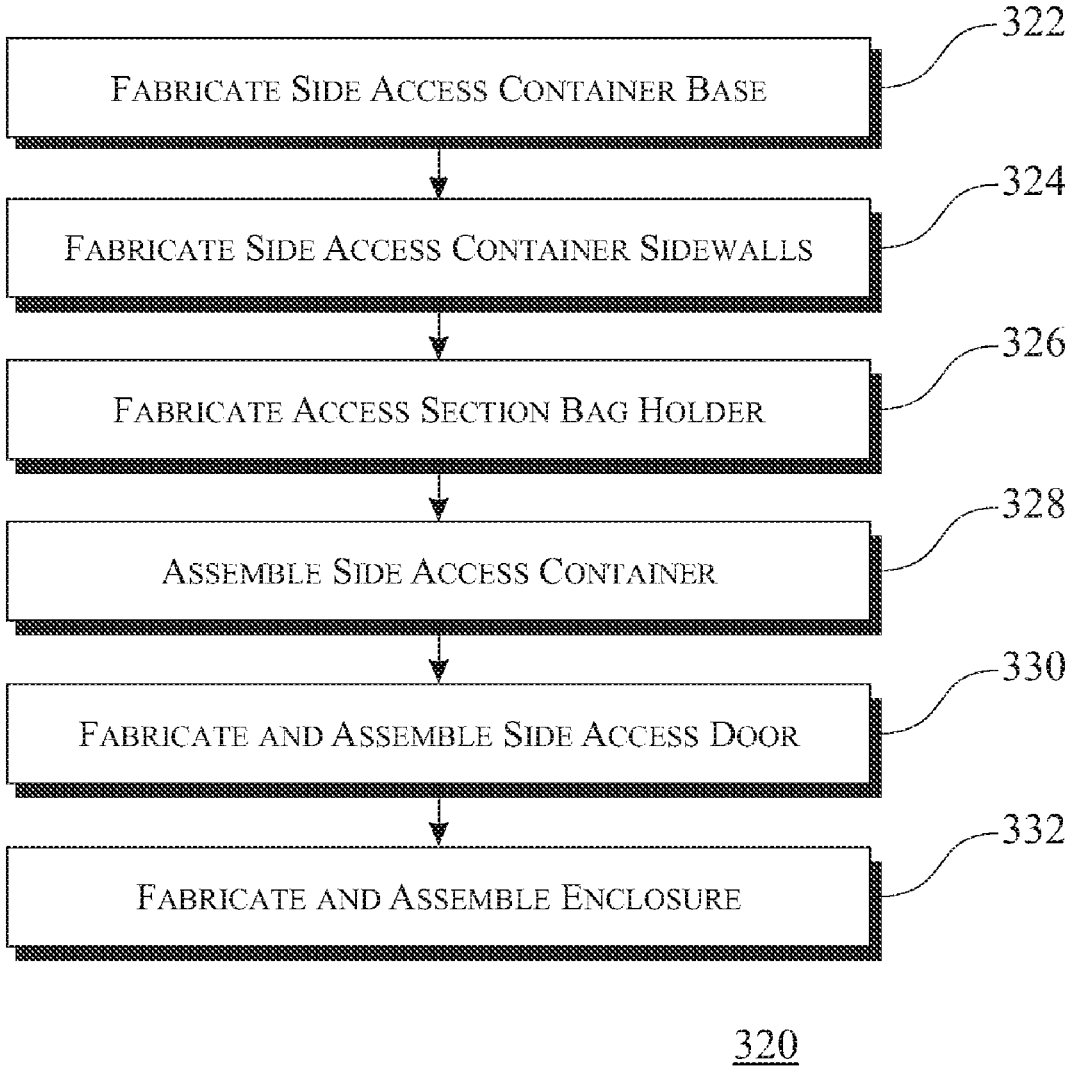
FIG. 12 illustrates a side access garbage container fabrication flow diagram.

FIG. 12 provides a side access garbage container fabrication flow diagram 320. The side access garbage container fabrication flow diagram 320 initiates with a side access container base fabrication step 322. The side access container base fabrication step 322 is accomplished via the formation of a base for the side access garbage container 100. This can be via stamping and forming a metal base, a molding process, a machining process, and the like. The base can be fabricated of a metal, wood, plastic, composite material, and the like. An optional sliding bag removal assistance base 154 can be assembled to a top of the base providing the user an apparatus for assisting in the removal of the filled removable trash bag 120. A slide mechanism 146 can be assembled to the bottom of the base should the side access garbage container 100 be for assembly into an external enclosure. The side access garbage container fabrication flow diagram 320 continues with a side access container sidewall fabrication step 324. The side access container sidewall fabrication step 324 is accomplished via the formation of a sidewall 102 for the side access garbage container 100. The sidewall 102 can be fabricated of a metal, wood, plastic, composite material, and the like and formed via a stamping and forming a metallic material, a molding process, a machining process, and the like. The sidewall 102 can be fabricated in a plurality of sections that are fastened together such as by welding two sections of metal, adhesive, fasteners, and the like. An access section bag holder fabrication step 326 is completed by fabricating the access section bag holder 114. The access section bag holder 114 can be formed via any of the previously mentioned materials and fabrication methods, or via cutting and bending a tube, a metal bar, and the like. Alternately, the sidewall 102 can completely cover the perimeter of the base and the trash removal access 116 section is then cut out of the sidewall 102 forming the access section bag holder 114. The side access garbage container 100 is assembled in accordance with a side access container assembly step 328. The sidewalls 102 are assembled to the container base. The access section bag holder 114 is assembled proximate the top of the sidewalls 102 above the trash removal access 116 section. The assembly would be respective to the selected material and designers choice. The access door 106 is fabricated and assembled to the side access garbage container 100 or external enclosure in accordance with a side access door fabrication and assembly step 330. Should the desired product incorporate an external enclosure, the external enclosure is fabricated and assembled in accordance with an external enclosure fabrication and assembly step 332. The external enclosure is generally fabricated using a composite wood core with a Formica exterior finish and fabricated in the shape of a cabinet as previously illustrated herein. It is recognized that a wide variety of other materials can be used and formed into a multitude of shapes. Additional items such as the side wall bag holder 112 and garbage deposition door 220 can be fabricated and assembled as desired.

The apparatus taught herein provides a design no longer requiring the user to lift the filled trash bag out of the garbage container. The lack of a lifting step significantly eases the garbage bag removal process.

The Applicants have provided a method and apparatus, with several options, for creating and using said side access garbage containment apparatus. Although the apparatus and methods taught herein are the preferred and alternate embodiments, it can be recognized that other form factors, materials, and methods of achieving the same results can be contrived from the disclosed teachings.

What is claimed is:

1. A side access garbage containment apparatus, said side access garbage containment apparatus comprising:

a container bottom having a perimeter approximately the dimensions of a perimeter of a garbage bag;

a vertically disposed containing member comprising a substantially inflexible side wall having a lower edge, a first vertical edge, a second vertical edge and a top edge, wherein the lower edge is contiguous to a majority of the container bottom perimeter with the vertical edges extend vertically upwards therefrom;

a garbage bag holder including the vertical containing member top edge and an access section upper bag holder which continues from the top edge spanning between the first vertical containing member edge and the second vertical containing member edge;

wherein the vertically disposed containing member is positioned proximate the garbage bag to support the garbage bag when being filled;

a side access opening, being an opening defined by the container bottom, the first vertical containing member edge, the second vertical containing member edge, and the access section upper bag holder, the side access opening providing access for removal of the garbage bag from the garbage bag containment apparatus; and an external enclosure having a vertical member that is placed about the garbage bag containment apparatus, the enclosure including an access door for the side access opening.

2. A side access garbage containment apparatus as recited in claim 1, wherein said access door covers said side access opening when said access door is closed and provides access to said side access opening when said access door is opened.

3. A side access garbage containment apparatus as recited in claim 2, wherein said access door is hingeably coupled to the external enclosure.

4. A side access garbage containment apparatus as recited in claim 1, said external enclosure further comprising a garbage deposition door, said garbage deposition door is positioned above a top edge of the substantially rigid side wall.

5. A side access garbage containment apparatus as recited in claim 4, wherein said garbage deposition door provides a user access to an opening of the garbage bag via a pivoting motion.

6. A side access garbage containment apparatus as recited in claim 1, said garbage bag containment apparatus further comprising a bag removal assistance base positioned below and slideably coupled to the container bottom.

7. A side access garbage containment apparatus, said side access garbage containment apparatus comprising:

a container bottom having a perimeter approximately the dimensions of a perimeter of a garbage bag;

a vertically disposed containing member comprising a substantially inflexible side wall having a lower edge, a first vertical edge, a second vertical edge and a top edge, wherein the lower edge is contiguous to a majority of the container bottom perimeter with the vertical edges extend vertically upwards therefrom;

a garbage bag holder including the vertical containing member top edge and an access section upper bag holder which continues from the top edge spanning between the first vertical containing member edge and the second vertical containing member edge;

wherein the vertically disposed containing member is positioned proximate the garbage bag to support the garbage bag when being filled;

a side access opening, being an opening defined by the container bottom, the first vertical containing member edge, the second vertical containing member edge, and the access section upper bag holder, the side access opening providing access for removal of the garbage bag from the garbage bag containment apparatus, a bag removal assistance base, said bag removal assistance base is positioned below and is slideably coupled to the container bottom; and an external enclosure having a vertical member that is placed about the garbage bag containment apparatus, the enclosure including an access door for the side access opening.

8. A side access garbage containment apparatus as recited in claim 7, wherein said access door covers said side access opening when said access door is closed and provides access to said side access opening when said access door is opened.

9. A side access garbage containment apparatus as recited in claim 8, wherein said access door is hingeably coupled to the external enclosure.

10. A side access garbage containment apparatus as recited in claim 7, said external enclosure further comprising a garbage deposition door, said garbage deposition door is positioned above a top edge of the substantially rigid side wall.

11. A side access garbage containment apparatus as recited in claim 10, wherein said garbage deposition door provides a user access to an opening of the garbage bag via a pivoting motion.

12. A side access garbage containment apparatus as recited in claim 7, the containment apparatus further comprising:

a bottom member assembled to the external enclosure proximate a lower edge; and a sliding interface between a bottom surface of the garbage bag containment apparatus and a top surface of the external enclosure bottom member.

13. A side access garbage containment apparatus, said side access garbage containment apparatus comprising:

a garbage bag containment apparatus comprising a container bottom, a vertically disposed containing member, said vertically disposed containing member having a substantially rigid side wall about the majority of a perimeter of the container bottom and a side access opening;

wherein the side access opening provides an opening with an opening bottom proximate the container bottom and a top proximate the top of said substantially rigid side wall and having a width sufficient for the removal of a filled garbage bag;

an access section bag holder assembled across a top of the side access opening; and a side access door, wherein said side access door covers said side access opening when said access door is closed and provides access to said side access opening when said access door is opened;

a garbage deposition door, said garbage deposition door is positioned above a top edge of the substantially rigid side wall;

an external enclosure having at least one vertical member that is placed about said garbage bag containment apparatus;

said side access door being moveably coupled to the external enclosure; and said garbage deposition door being pivotally coupled to the external enclosure.

14. A side access garbage containment apparatus as recited in claim 13, wherein said access door is hingeably coupled to the external enclosure.

15. A side access garbage containment apparatus as recited in claim 13, wherein said garbage deposition door provides a user access to an opening of the garbage bag via a pivoting motion.

16. A side access garbage containment apparatus as recited in claim 13, said garbage bag containment apparatus further comprising a bag removal assistance base positioned below and slideably coupled to the container bottom.

17. A side access garbage containment apparatus as recited in claim 13, the containment apparatus further comprising:

a bottom member assembled to the external enclosure proximate a lower edge; and a sliding interface between a bottom surface of the garbage bag containment apparatus and a top surface of the external enclosure bottom member.

* * * * *